US010454186B2

(12) United States Patent
Boyanov et al.

(10) Patent No.: US 10,454,186 B2
(45) Date of Patent: Oct. 22, 2019

(54) LIGHTWEIGHT PLASTIC ANTENNA

(71) Applicant: Gilat Satellite Networks Ltd., Petah Tikva (IL)

(72) Inventors: Victor Liudmilov Boyanov, Sofia (BG); Vesselin Nikolov Peshlov, Sofia (BG); Mario Ganchev Gachev, Sofia (BG)

(73) Assignee: Gilat Satellite Networks Ltd., Petah Tikva (IL)

( * ) Notice: Subject to any disclaimer, the term of this patent is extended or adjusted under 35 U.S.C. 154(b) by 0 days.

(21) Appl. No.: 15/048,527

(22) Filed: Feb. 19, 2016

(65) Prior Publication Data

US 2016/0248168 A1 Aug. 25, 2016

Related U.S. Application Data

(60) Provisional application No. 62/120,366, filed on Feb. 24, 2015.

(51) Int. Cl.
*H01Q 21/06* (2006.01)
*H01Q 1/28* (2006.01)
*H01Q 21/00* (2006.01)

(52) U.S. Cl.
CPC ..... *H01Q 21/064* (2013.01); *H01Q 1/28* (2013.01); *H01Q 21/0087* (2013.01)

(58) Field of Classification Search
CPC ..... H01Q 1/28; H01Q 1/288; H01Q 21/0087; H01Q 21/064
See application file for complete search history.

(56) References Cited

U.S. PATENT DOCUMENTS 4,743,915 A * 5/1988 Rammos ..... H01Q 21/064 343/776
4,827,276 A * 5/1989 Fukuzawa ..... H01Q 21/0081 343/769
5,818,395 A * 10/1998 Wolcott ..... H01Q 1/08 343/753
6,201,508 B1 * 3/2001 Metzen ..... H01Q 13/0258 343/776
6,297,774 B1 * 10/2001 Chung ..... H01Q 21/0087 343/700 R
2002/0109633 A1 * 8/2002 Ow ..... H01Q 9/0407 343/700 MS
2005/0146473 A1 * 7/2005 Stoyanov ..... H01Q 1/1264 343/753
2012/0218160 A1 * 8/2012 Montgomery ..... H01Q 13/0275 343/776
2013/0241791 A1 * 9/2013 Anderson ..... H01Q 15/008 343/848

* cited by examiner

*Primary Examiner* — Daniel Munoz
(74) *Attorney, Agent, or Firm* — Banner & Witcoff, Ltd.

(57) ABSTRACT

A microwave antenna for two-way communication via a satellite is presented. The antenna may feature lightweight plastic construction that may allow the antenna to be highly dynamic, to feature high tracking capabilities and to require a much simpler drive construction. The presented antenna may provide high reliability at a reasonable cost. Such antenna may be highly suitable for on-the-move communication applications. The antenna may be used for supporting airborne communication systems operative via satellites.

22 Claims, 7 Drawing Sheets

LIGHTWEIGHT PLASTIC ANTENNA

PRIORITY CLAIM

This application claims priority to U.S. Provisional Patent Application Ser. No. 62/120,366, filed Feb. 24, 2015, and entitled "Lightweight Plastic Antenna," the disclosure of which is incorporated by reference herein in its entirety and made part hereof.

FIELD

Aspects of the disclosure pertain to microwave antennas in general and to two-way communications antennas for communication via satellite in particular.

BACKGROUND

High-speed broadband communications, including Internet connectivity, on board commercial flights is an important service, especially in long distance flights. Satellite communication is perhaps the best solution for providing broadband communications to an airplane during flight. To support such satellite communication, a mobile satellite terminal suitable for supporting airborne applications has to be installed on board the airplane.

Many satellite communication systems make use of reflector-based antennas or panel (array) antennas. The terminals included in such systems, such as very small aperture terminals (VSATs), are often equipped with such antennas for providing either one-way (receive-only) or two-way (transmit-receive) communication. Communication can be provided in such systems by either fixed terminals, transportable terminals, or on-the-move terminals.

Panel (array) technology has an advantage over reflector-based antennas when it comes to providing communication using on-the-move terminals. Panel technology allows manufacturing of low profile antenna terminals that are more suitable for mounting on a vehicle and for use while the vehicle is on the move. An example of a low-profile mobile in motion antenna is disclosed in U.S. Pat. No. 7,379,707 to DiFonzo et al.

However, low profile antennas based on panel technology have several disadvantages. Low profile antennas based on panel technology have a higher complexity relative to reflector-based antennas. Additionally, existing technologies of low profile panel (array) antennas produce relatively heavy antennas. A relatively high antenna weight makes it difficult to introduce such antennas for mobility applications, especially in the case of airborne applications where weight is an important factor.

SUMMARY

The following presents a simplified summary in order to provide a basic understanding of some aspects of the disclosure. This summary is not an extensive overview of the disclosure. It is intended neither to identify key or critical elements of the disclosure nor to delineate the scope of the disclosure. The following summary merely presents some aspects of the disclosure in a simplified form as a prelude to the description below.

In accordance with aspects of the disclosure, an antenna panel module is presented. The antenna panel module may include a grating lobes suppression layer, a radiating layer, and a feed layer. The grating lobes suppression layer, the radiating layer and the feed layer may be made of any of metallized plastic, conductive plastic, or a combination of any of metallized plastic, conductive plastic, metal, and metal parts.

In accordance with other aspects of the disclosure, an antenna panel may include one or more antenna panel modules, wherein each of the one or more antenna panel modules comprises a first port corresponding to a first polarization and a second port corresponding to a second polarization that is different from the first polarization, wherein each of the one or more antenna panel modules comprises a grating lobes suppression layer, a radiating layer and a feed layer, wherein the grating lobes suppression layer, the radiating layer and the feed layer of each antenna panel module of the one or more antenna panel modules are made of any of metallized plastic, conductive plastic, or a combination of any of metallized plastic, conductive plastic, metal and metal parts, and wherein the number of antenna panel modules in the antenna panel is determined at least in accordance with a gain property of the antenna panel.

In accordance with aspects of the disclosure, an antenna system is presented. The antenna system may include an antenna panel comprising one or more antenna panel modules, wherein each of the one or more antenna panel modules comprises at least one radiating layer and at least one feed layer, and wherein the at least one radiating layer and the at least one feed layer of each antenna panel module of the one or more antenna panel modules are made of any of metallized plastic, conductive plastic, or a combination of any of metallized plastic, conductive plastic, metal and metal parts. The antenna system may additionally include a supporting structure, wherein the antenna panel is coupled to the supporting structure, and wherein the antenna system is configured to support mounting of the antenna system on a surface of an airplane fuselage.

In accordance with aspects of the disclosure, a lightweight low-profile antenna construction is presented. In some embodiments, the lightweight low-profile antenna construction may comprise at least an antenna panel that may be produced of (e.g. molded) metallized plastic parts. In some embodiments, the presented lightweight low-profile antenna may be used for two-way (transmit/receive) applications. In some embodiments, the lightweight low-profile antenna may be configured to operate, for example, in any of the Ku-band frequency range, the K-band frequency range, and the Ka-band frequency range. In some embodiments, the lightweight low-profile antenna may be configured to operate in two orthogonal linear polarizations (e.g. vertical polarization and horizontal polarization). In some embodiments, the lightweight low-profile antenna may be configured to operate in two orthogonal circular polarizations (e.g. Left Hand circular polarization and Right Hand circular polarization). In some embodiments, the lightweight low-profile antenna may be configured to operate using geostationary satellites or using satellites that may be operative in other types of orbits (including, but not limited to, low earth orbit, medium earth orbit, high elliptical orbit or any other type of orbit).

In accordance with aspects of the disclosure, the antenna panel of the lightweight low-profile antenna may be configured to have a layered structure, wherein the layered structure may simplify at least a production process and/or an assembling process of the antenna panel. Metal-coated (metallized) plastic technology may be used for producing one or more of the antenna panel layers for at least the purpose of reducing the weight of the assembled antenna, both directly and indirectly (e.g. the weight of the antenna mechanics (e.g. frames, platforms, motors, etc.) that may be needed for supporting the antenna panel may also be reduced as a result of reducing the weight of the antenna panel). It may be noted that reducing the weight of the antenna panel and/or the weight of the assembled antenna may also result in improving the antenna's satellite tracking capability (for example, since lightweight devices may be easier to steer accurately). In some embodiments, the metallized plastic layers of the antenna panel may be produced using one or more methods, including but not limited to, molding, milling, 3-dimensional (3D) printing, or sintering.

In accordance with aspects of the disclosure, the antenna panel may be constructed in a modular manner using one or more antenna panel modules, wherein each module may be configured to have a layered structure as previously described. A modular construction may allow construction of antenna panels with a variable number of modules. In some embodiments, the number of modules in any specific antenna construction may be determined at least in accordance with a gain that the antenna may be required to provide.

BRIEF DESCRIPTION OF THE DRAWINGS

Figure 1:
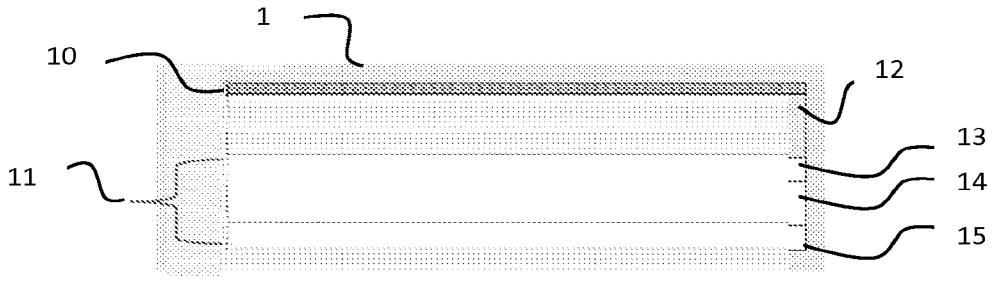
Figure 2:
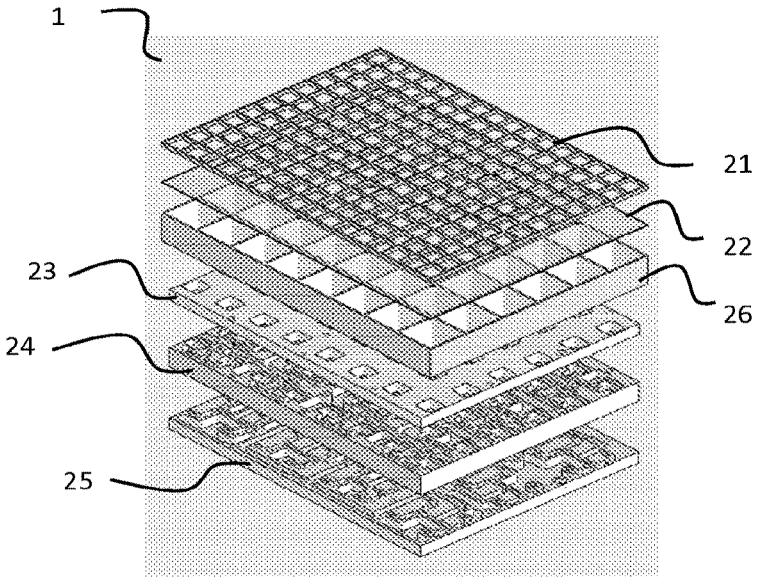
Figure 3:
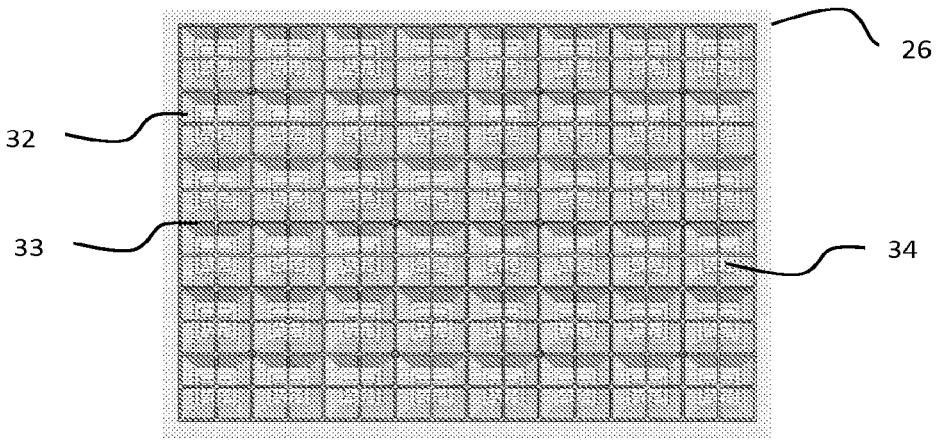
Figure 4A:
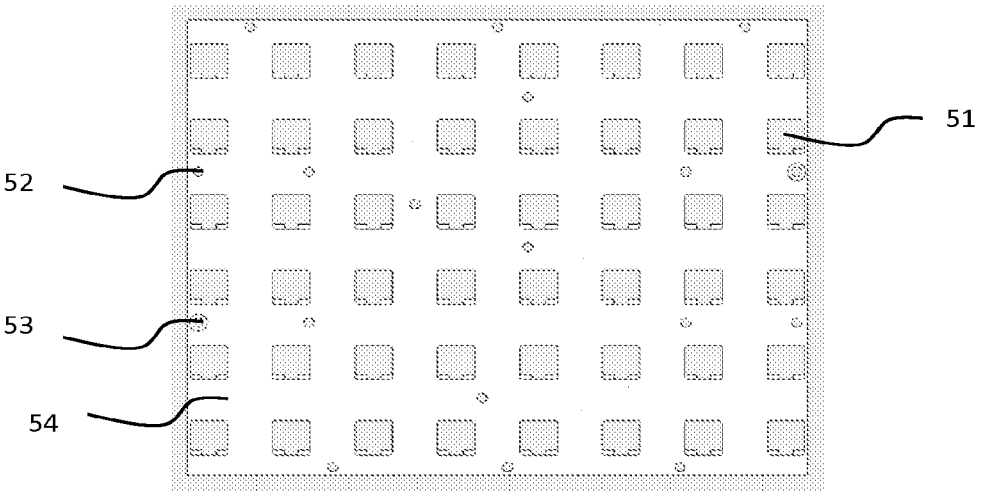
Figure 4B:
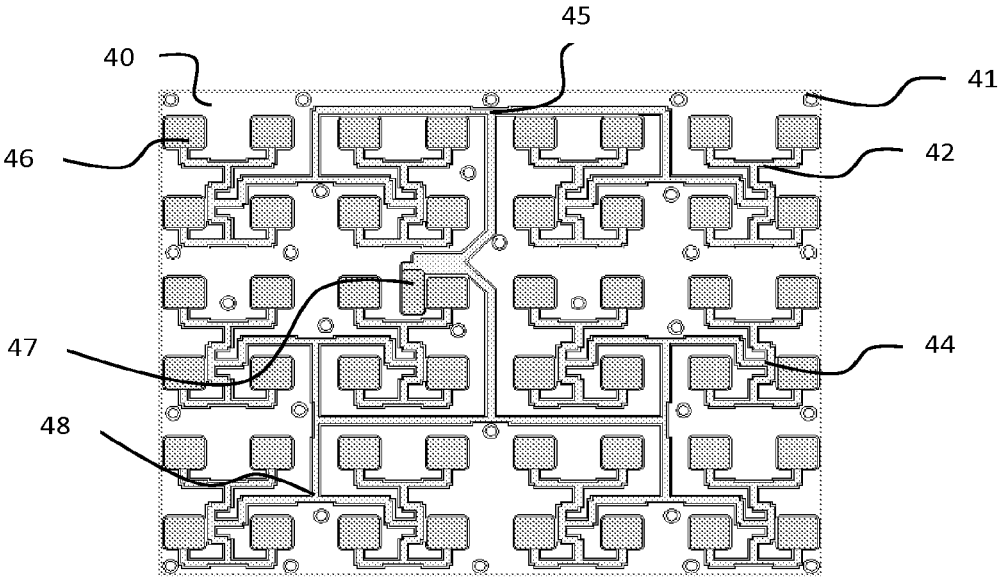
Figure 5A:
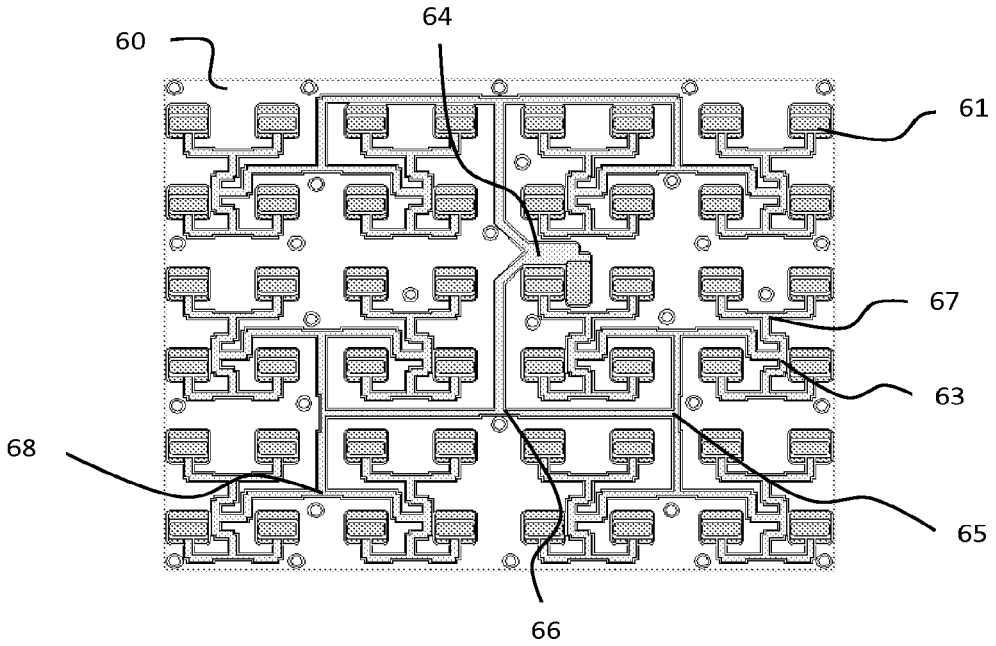
Figure 5B:
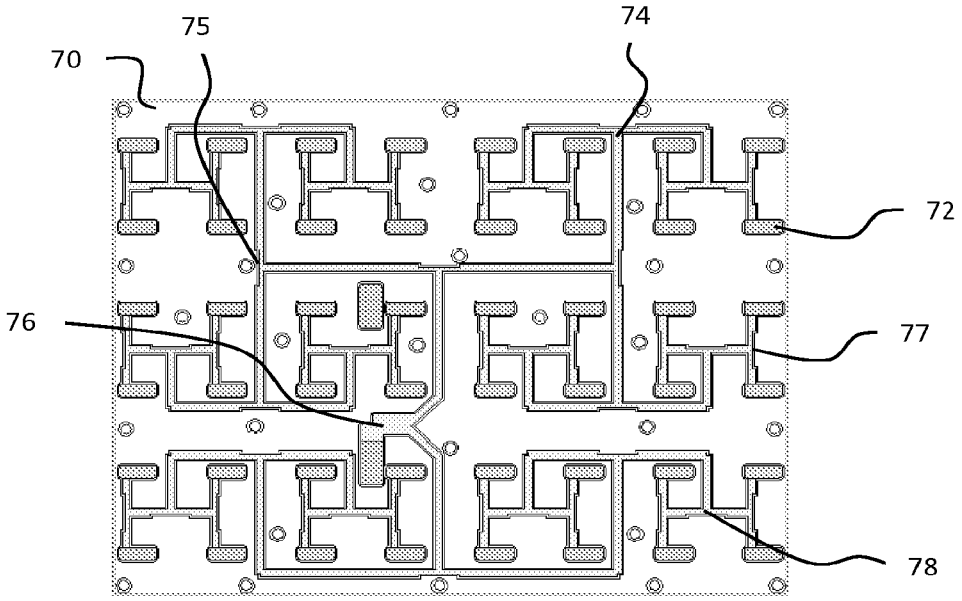
Figure 6A:
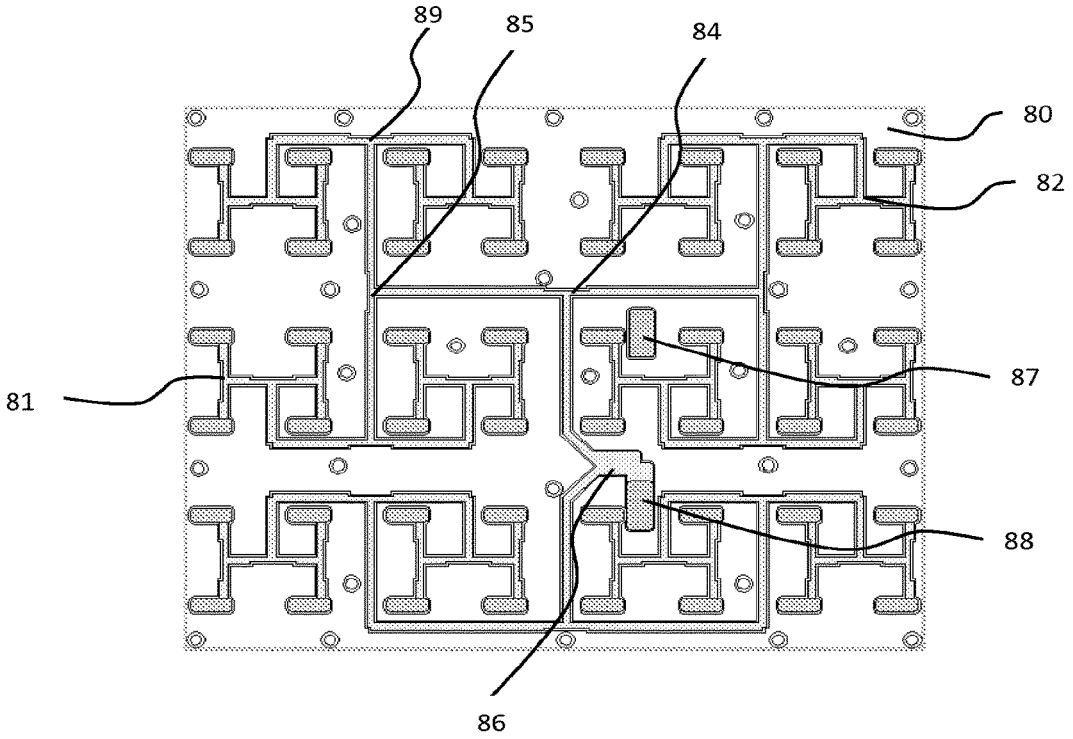
Figure 6B:
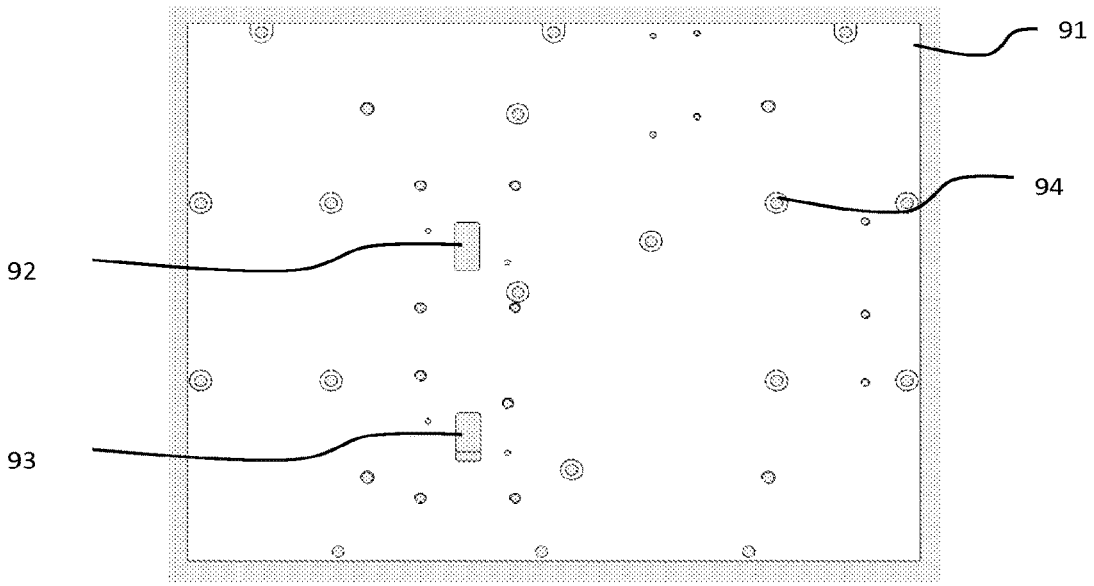
Figure 7:
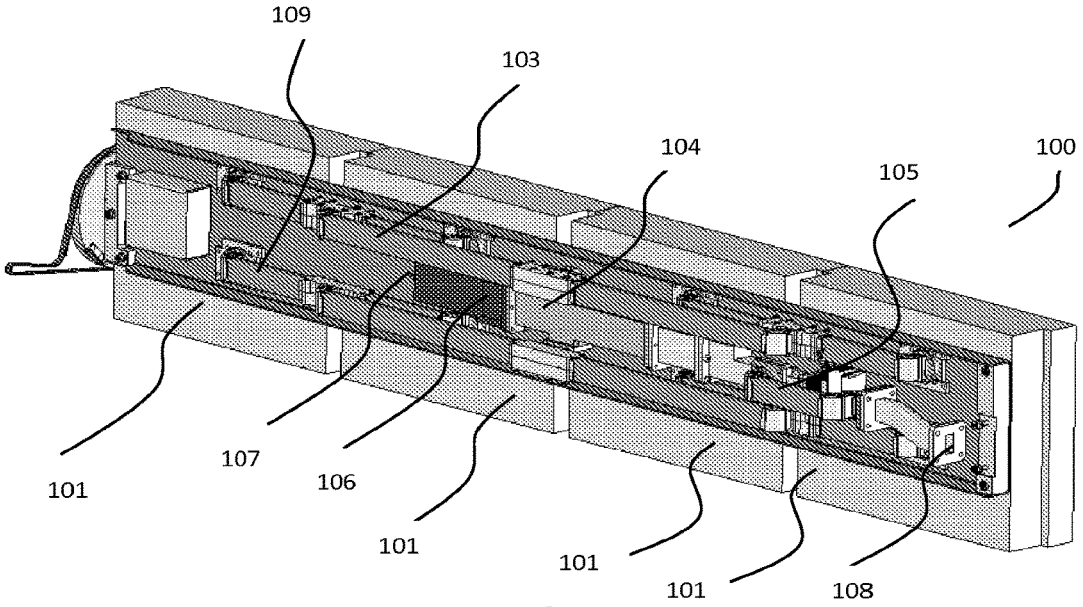
Figure 8:
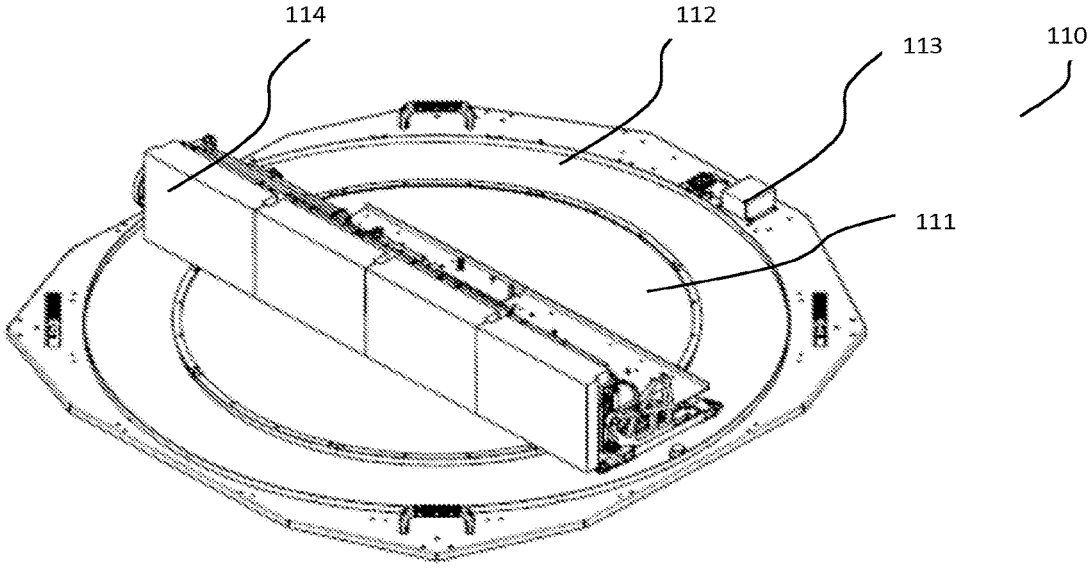
Figure 9:
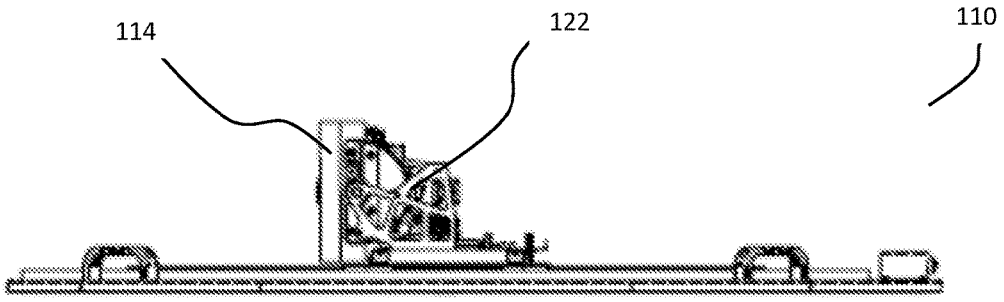
Figure 10:
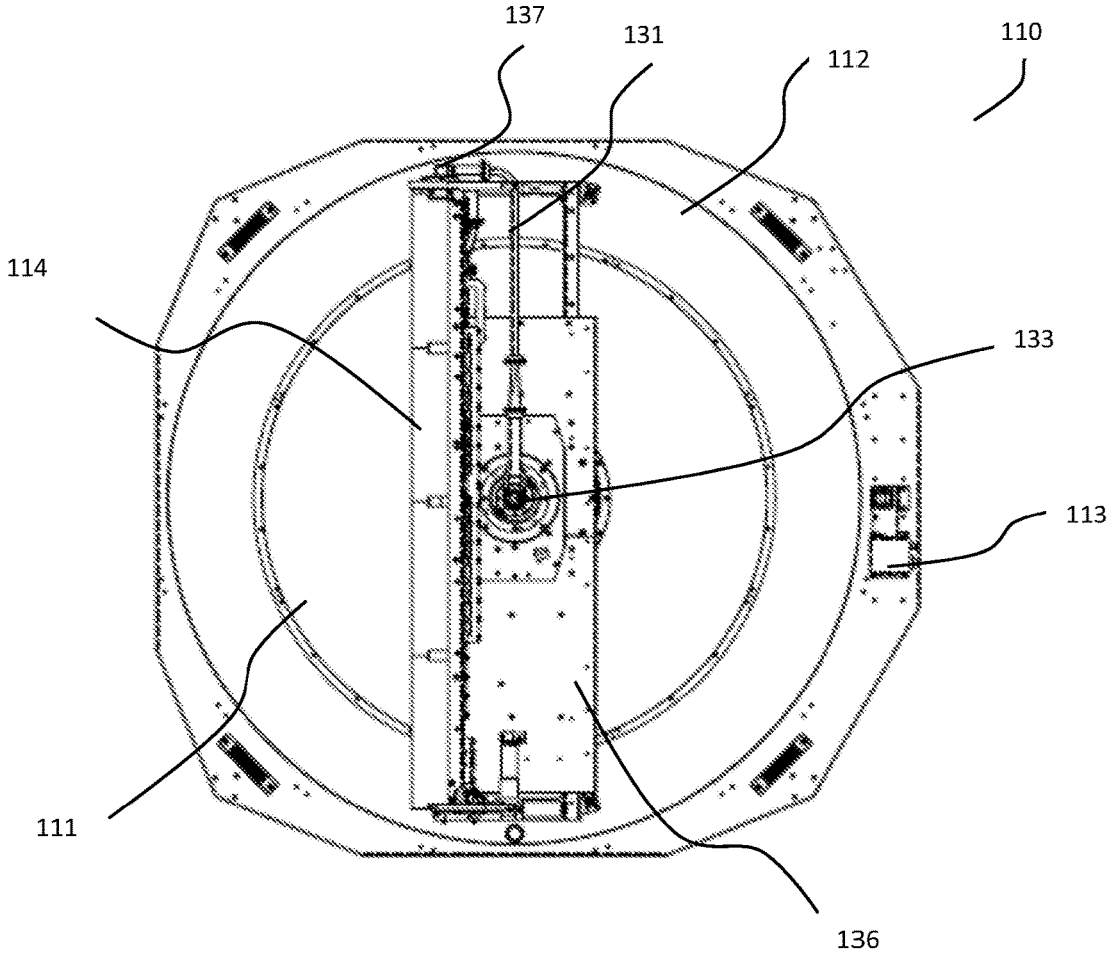
Figure 11:
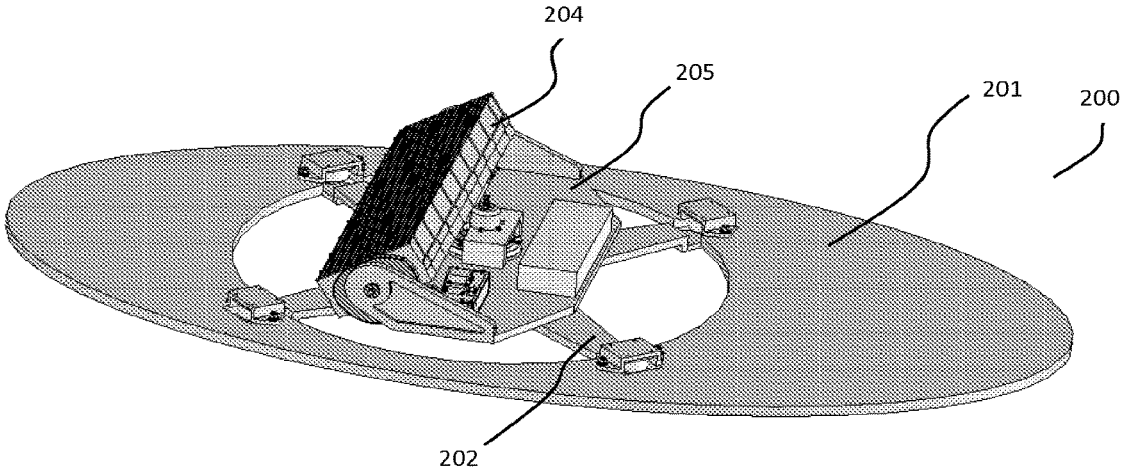

Having thus described the disclosure in general terms, reference will now be made to the accompanying drawings, which are not necessarily drawn to scale, and wherein:

FIG. 1 shows an illustration of a layered antenna panel module in accordance with aspects of the disclosure;

FIG. 2 shows an illustration of a construction of a layered antenna panel module in accordance with aspects of the disclosure;

FIG. 3 shows an illustration of a radiating layer of an antenna panel module in accordance with aspects of the disclosure;

FIG. 4*a* shows a top view of a first feed layer in accordance with aspects of the disclosure;

FIG. 4*b* shows a bottom view of a first feed layer in accordance with aspects of the disclosure;

FIG. 5*a* shows a top view of a second feed layer in accordance with aspects of the disclosure;

FIG. 5*b* shows a bottom view of a second feed layer in accordance with aspects of the disclosure;

FIG. 6*a* shows a top view of a third feed layer in accordance with aspects of the disclosure;

FIG. 6*b* shows a bottom view of a third feed layer in accordance with aspects of the disclosure;

FIG. 7 shows an example of an antenna panel in accordance with aspects of the disclosure;

FIG. 8 shows an example mounting of an antenna panel on a platform in accordance with aspects of the disclosure;

FIG. 9 shows a side view of an example mounting of an antenna panel on a platform in accordance with aspects of the disclosure;

FIG. 10 shows a top view of an example mounting of an antenna panel on a platform in accordance with aspects of the disclosure; and FIG. 11 shows an example mounting of an antenna platform in accordance with aspects of the disclosure.

DETAILED DESCRIPTION

FIG. 1 shows an example antenna panel module 1 that may comprise multiple layers, including at least a grating lobes suppression layer 10, a radiating layer 12 and a feed layer 11. In some embodiments, the feed layer 11 of antenna panel module 1 may comprise three or more sub-layers. The three or more sub-layers of feed layer 11 may support reception and/or transmission of at least two signals in two independent polarizations. The three or more sub-layers of the feed layer 11 may comprise at least a polarization selective layer 13, a first polarization summation layer 14 and a second polarization summation layer 15.

FIG. 2 shows an example construction of a multi-layer antenna panel module, such as antenna panel module 1. It may be noted that FIG. 1 illustrates a division of antenna panel module 1 into multiple logical layers. Each logical layer shown in FIG. 1 may be associated with one or more functions. FIG. 2 illustrates a division of antenna panel module 1 into physical layers and/or components, e.g. in accordance with some embodiments of constructing antenna panel module 1. Consequently, a logical layer shown in FIG. 1 may be embodied using components that may be associated with two different layers as shown in FIG. 2.

In reference to FIG. 2, antenna panel module 1 may comprise a metallized plastic grid 21 and a plastic cover 22. The metallized plastic grid 21 and the plastic cover 22 may be configured to form a grating lobes suppression layer, such as grating lobes suppression layer 10 of FIG. 1. In some embodiments, the metallized plastic grid 21 may be further configured as an impedance matching device. In some embodiments, the plastic cover 22 may be configured to seal an aperture of the antenna panel module 1. Sealing the aperture may provide additional protection to the aperture from possible harsh environmental conditions, such as conditions that may be associated with airborne application. In another embodiment, the plastic cover 22 may comprise one or more holes for at least the purpose of allowing moisture control and/or ventilation of the internal volume of the antenna panel module 1.

Antenna panel module 1 may further comprise a molded plastic horn antenna array 26. Molded plastic horn antenna array 26 may correspond to radiating layer 12 of FIG. 1. In some embodiments, the radiating layer of antenna panel module 1 may comprise an antenna array of open-ended waveguides (not shown in FIG. 2) in place of molded plastic horn antenna array 26. In some embodiments, antenna panel module 1 may further comprise three (3) additional layers including a first feed layer 23, a second feed layer 24 and a third feed layer 25. One or more of metallized plastic grid 21, plastic cover 22, first feed layer 23, second feed layer 24, third feed layer 25, and molded plastic horn antenna array 26 may be assembled using any of guiding pins, guiding screws, gluing, or welding techniques, for at least the purpose of forming antenna panel module 1. In some embodiments, all of metallized plastic grid 21, plastic cover 22, first feed layer 23, second feed layer 24, third feed layer 25, and molded plastic horn antenna array 26 may be fabricated entirely of metallized plastic or conductive plastic. In some embodiments, metallized plastic grid 21, plastic cover 22, first feed layer 23, second feed layer 24, third feed layer 25, and molded plastic horn antenna array 26 may be fabricated partly using metallized plastic (or conductive plastic) and partly using metal and/or metal parts.

FIG. 3 may show a top view of an example embodiment of molded plastic horn antenna array 26. Molded plastic horn antenna array 26 may comprise at least an array of broad band horn antennas 32, step-shaped square waveguides 34 and a metallized plastic grid 33. The step-shaped square waveguides 34 may be configured as feeds for the broad band horn antennas 32 for at least any of the purposes of achieving broad band operation for antenna panel module 1 and reducing a height property of horn antenna array 26. The metallized plastic grid 33 may be mounted on top of the array of broad band horn antennas 32 for at least the purpose of improving the antenna panel performance. For example, mounting the metallized plastic grid 33 may reduce phase errors in the antenna panel aperture.

FIG. 4*a* illustrates a top view of first feed layer 23 (shown in FIG. 2). First feed layer 23 may comprise orthomode polarizer 54. Orthomode polarizer 54 may be formed using molded plastic. In some embodiments, antenna panel module 1 may be configured to transmit and/or receive signals using orthogonal circular polarizations. In these embodiments, a septum polarizer (not shown in FIG. 4*a*) may be used in place of orthomode polarizer 54. Orthomode polarizer 54 may include one or more orthomode cavities 51. In some embodiments, orthomode cavities 51 of orthomode polarizer 54 may be formed within the metallized (molded) plastic that may make up the first feed layer 23. Orthomode polarizer 54 may include mounting holes 52 and 53. In some embodiments, antenna panel module 1 may be constructed using guiding pins and screws though mounting holes 52 and 53. In these embodiments, orthomode polarizer 54 may be attached to the bottom side of horn antenna array 26. Orthomode polarizer 54 may be configured to separate signals corresponding to a first polarization from signals corresponding to at least a second polarization. The signals corresponding to the first polarization and the signals corresponding to at least the second polarization may be received and/or transmitted by the antenna panel module 1. Once separated by orthomode polarizer 54, the signals corresponding to the first polarization may be summed by a first polarization waveguide summation circuit. Additionally, or alternatively, the signals corresponding to at least the second polarization may be summed by a second polarization summation circuit.

FIG. 4*b* illustrates a bottom view of first feed layer 23 (shown in FIG. 2). First feed layer 23 may include waveguide summation circuit 40. Waveguide summation circuit 40 may be formed using molded plastic. Waveguide summation circuit 40 may be an upper part of the first polarization waveguide summation circuit that may be configured to sum signals corresponding to a first polarization. Waveguide summation circuit 40 may include cavities 42, 44, 46, 47, and 48 that may be formed within the metallized (molded) plastic that may make up the first feed layer 23. Waveguide summation circuit 40 may further include mounting holes 41.

FIG. 5*a* illustrates a top view of second feed layer 24 (shown in FIG. 2). Second feed layer 24 may include waveguide summation circuit 60. Waveguide summation circuit 60 may be a bottom part of the first polarization waveguide summation circuit configured to sum signals corresponding to a first polarization. Waveguide summation circuit 60 may include one or more cavities 61, 63, 65, 67, and 68. In some embodiments, one or more of cavities 61, 63, 65, 67, and 68 may be formed within the metallized (molded) plastic that may make up the second feed layer 24. Upon constructing antennal panel module 1, waveguide summation circuit 60 may be attached to waveguide summation circuit 40 (shown in FIG. 4*b*) for at least the purpose of forming the first polarization waveguide summation circuit.

FIG. 5*b* illustrates a bottom view of second feed layer 24 (shown in FIG. 2). Second feed layer 24 may include waveguide summation circuit 70. Waveguide summation circuit 70 may be an upper part of a second polarization waveguide summation circuit. The second polarization waveguide summation circuit may be configured to sum signals corresponding to a second polarization that is different from the first polarization. Waveguide summation circuit 70 may include cavities 72, 74, 75, 76, 77, and 78. One or more of cavities 72, 74, 75, 76, 77, and 78 may be formed within the metallized (molded) plastic that may make up the second feed layer 24.

FIG. 6*a* illustrates a top view of third feed layer 25 (shown in FIG. 2). Third feed layer 25 may include waveguide summation circuit 80. Waveguide summation circuit 80 may be a bottom part of the second polarization waveguide summation circuit. Waveguide summation circuit 80 may include cavities 81, 82, 84, 85, 86, 87, 88, and 89. In some embodiments, one or more of cavities 81, 82, 84, 85, 86, 87, 88, and 89 may be formed within the metallized (molded) plastic that may make up the third feed layer 25. Upon constructing antenna panel module 1, waveguide summation circuit 80 may be attached to waveguide summation circuit 70 (shown in FIG. 5*b*) for at least the purpose of forming the second polarization waveguide summation circuit.

FIG. 6*b* may illustrate a bottom view of third feed layer 25 (shown in FIG. 2). Third feed layer 25 may include second polarization summation circuit. The bottom side 91 of second polarization summation circuit may comprise a first waveguide antenna output port 92 that may correspond to the first polarization and a second antenna output port 93 that may correspond to the second polarization. The bottom side 91 of the second polarization summation circuit may include one or more holes 94. Holes 94 may be configured for insertion of guiding pins during assembly of antenna panel module 1.

The first polarization waveguide summation circuit may be comprised of waveguide summation circuit 40 and waveguide summation circuit 60. The first polarization waveguide summation circuit may further comprise multiple broad band step-tapered waveguide cavities, such as cavities 42, 44, 45, 46, 47, and 48, (each shown in FIG. 4*b*) and cavities 61, 63, 64, 65, 67, and 68 (each shown in FIG. 5*a*). One of more these cavities, such as cavities 46 and 61, may be configured as antenna element transition cavities. Other cavities may be configured to form multiple T-junctions for summing signals corresponding to multiple antenna elements. At least one of the multiple T-junctions may be configured to sum signals corresponding to two or more antenna elements in accordance with coefficients that may be determined at least in accordance with a desired amplitude distribution (tapering) in the aperture of antenna panel module 1. One or more of the multiple T-junctions, such as a T-junction that may be formed by cavities such as cavity 42 and cavity 67, may be configured to sum signals corresponding to two antenna elements (e.g. transitioned via antenna element transition cavities, such as cavity 46 and cavity 61). One or more of the multiple T-junctions, such as a T-junction that may be formed by cavities such as cavity 44 and cavity 63, may be configured to sum signals corresponding to two (2) pairs of antenna elements. In a similar manner, one or more of the multiple T-junctions, such as a T-junction that may be formed by cavities such as cavity 48 and cavity 68, may be configured to sum signals corresponding to four (4) pairs of antenna elements. Similarly, one or more of the multiple T-junctions, such as a T-junction that may be formed by cavities such as cavity 45 and cavity 65, may be configured to sum signals corresponding to eight (8) pairs of antenna elements. The output signals for the first polarization waveguide summation circuit may be produced using a final summation T-junction that may be formed by cavities such as cavity 47 and cavity 64. The output signals for the first polarization waveguide summation circuit may be fed to the first polarization antenna output port 92 (shown in FIG. 6*b*).

In some embodiments, any of waveguide summation circuit 40 and waveguide summation circuit 60 may comprise one or additional cavities (not shown in FIG. 4*b* or FIG. 5*a*). The additional cavities may be utilized for reducing the weight of the first polarization waveguide summation circuit and consequently the overall weight of antenna panel module 1. The additional cavities may be configured (for example, through their geometries and/or their locations within their respective waveguide summation circuits) such that the inclusion of the additional cavities does not interfere with the proper operation of the first polarization waveguide summation circuit.

The second polarization waveguide summation circuit may be comprised of waveguide summation circuit 70 and waveguide summation circuit 80. The second polarization waveguide summation circuit may further comprise multiple broad band step-tapered waveguide cavities. For example, second polarization waveguide summation circuit may include cavities 72, 74, 75, 76, and 78 (shown in FIG. 5*b*) and cavities 81, 82, 85, 86, 87, 88, and 89 (shown in FIG. 6*a*). One or more cavities, such as cavities 72, 87 and 88, may be configured as antenna element transition cavities. One or more cavities, such as cavity 72, may be configured as inputs for the second polarization summation circuit. One or more cavities, such as cavities 87 and 88, may be coupled to the antenna output ports 92 and 93 (shown in FIG. 6*b*), respectively. One or more cavities may be configured to form multiple T-junctions for summing signals corresponding to multiple antenna elements. At least one of these one or more T-junctions may be configured to sum signals corresponding to two or more antenna elements in accordance with coefficients that may be determined at least in accordance with a desired amplitude distribution (tapering) in the aperture of the antenna panel module 1. One or more of the multiple T-junctions, such as a T-junction that may be formed by cavities such as cavity 77 and cavity 81, may be configured to sum signals corresponding to two antenna elements (e.g. transitioned via cavities such as antenna element transition cavity 72). One or more of the multiple T-junctions, such as a T-junction that may be formed by cavities such as cavity 78 and cavity 82, may be configured to sum signals corresponding to two (2) pairs of antenna elements. In a similar manner, one or more of the multiple T-junctions, such as a T-junction that may be formed by cavities such as cavity 74 and cavity 89, may be configured to sum signals corresponding to four (4) pairs of antenna elements. Similarly, one or more of the multiple T-junctions, such as a T-junction that may be formed by cavities such as cavity 75 and cavity 85, may be configured to sum signals corresponding to eight (8) pairs of antenna elements. The output signals for the second polarization waveguide summation circuit may be produced using a final summation T-junction that may be formed by cavities such as cavity 76 and cavity 86. The output signals for the second polarization waveguide summation circuit may be fed to the second polarization antenna output port 93 (shown in FIG. 6*b*).

In some embodiments, any of waveguide summation circuit 70 and waveguide summation circuit 80 may comprise one or more additional cavities (not shown in FIG. 5*b* and FIG. 6*a*). The one or more additional cavities may be utilized to reduce the weight of the second polarization waveguide summation circuit and consequently the overall weight of antenna panel module 1. The additional cavities may be configured (for example, through their geometries and/or their locations within their respective waveguide summation circuits) such that the inclusion of the additional cavities does not interfere with the proper operation of the second polarization waveguide summation circuit.

In one or more embodiments, the radiating layer 12 may comprise an antenna array comprising open-ended waveguides. In these embodiments, the first polarization waveguide summation circuit and/or the second polarization waveguide summation circuit may be replaced by a first summation circuit and/or a second summation circuit, respectively. The first summation circuit and/or the second summation circuit may be constructed using, for example, strip lines, substrate embedded or dielectric filed waveguide structures, and/or any combination of the above and of air-filled waveguides.

FIG. 7 shows an example of an antenna panel 100. Antenna panel 100 may comprise four antenna panel modules 101, waveguides combiners 103 and 109, a diplexer 104, an electronically controlled polarization adjustment device 106, a mechanically controlled polarization adjustment device 105, a port for received signals 107, and a port for transmitted signals 108. The port for received signals 107 may be a coaxial port that may be coupled to the electronically controlled polarization adjustment device 106. The port for transmitted signals 108 may be a waveguide port that may be coupled to the mechanically controlled polarization adjustment device 105. In some embodiments, each of the antenna panel modules 101 may be constructed in a similar manner as antenna panel module 1, as described above. The illustration of four antenna panel modules 101 is non-limiting, and the number of antenna panel modules 101 may be adjusted in accordance with a gain property of the antenna panel 100.

Waveguide combiners 103 and 109 may be configured to couple with antenna panel modules 101 at the respective output ports of each of the antenna panel modules 101. For example, waveguide combiner 103 may be configured to couple with antenna module 101 at port 92 (shown in FIG. 6*b*), and waveguide combiner 109 may be configured to couple with antenna module 101 at port 93 (shown in FIG. 6*b*). Waveguide combiner 103 may be configured to combine signals received from the antenna panel modules 101 in accordance with a first polarization. Additionally, or alternatively, waveguide combiner 103 may be configured to distribute signals to be transmitted via the antenna panel modules 101 in accordance with the first polarization. Waveguide combiner 109 may be configured to combine signals received from the antenna panel modules 101 in accordance with a second polarization. The second polarization may be different from the first polarization. Additionally, or alternatively, waveguide combiner 109 may be configured to distribute signals to be transmitted via the antenna panel modules 101 in accordance with the second polarization. Diplexer 104 may be configured to have four (4) ports and to separate the received signals from the signals to be transmitted. For example, diplexer 104 may be configured to couple with the waveguide combiners 103 and 109 using a first port and a second port respectively. Diplexer 104 may further be configured to output the received signals via a third port. The third port may be coupled to electronically controlled polarization adjustment device 106. Diplexer 104 may further be configured to receive the signals to be transmitted via a fourth port. The fourth port may be coupled to mechanically controlled polarization adjustment device 105.

In satellite communications using linear polarization, the polarization of a signal received from a satellite at a terminal antenna and/or the polarization of a signal transmitted from a terminal antenna to the satellite may be neither strictly vertical nor strictly horizontal with respect to the earth surface (e.g. at the location of the terminal antenna), but rather tilted at an angle. The polarization tilt angle may depend on one or more of a position of the terminal antenna relative to a position of the satellite, and on an angle at which a mounting surface on which the antenna may be mounted may be tilted, e.g. relative to an horizon (e.g. in case the mounting surface is not leveled or completely parallel to the horizon). In case of a mobile terminal, the tilt angle may dynamically change in accordance with movement of the terminal. For example, the tilt angle may be dynamically changed in accordance with a change in a position of the terminal antenna relative to a position of the satellite. Additionally, or alternatively, the tilt angle may be dynamically changed in accordance with a change in a tilt angle of a mounting surface which the antenna may be mounted on (e.g. like in case of an airborne platform when the plane may be turning). Therefore, at least in the case of a mobile terminal, in addition to tracking the satellite (relative) position, and/or adjusting the antenna azimuth and/or elevation for at least the purpose of maintaining the antenna directed at the satellite, it may be necessary also to track and/or adjust one or more of the reception polarization angle and the transmission polarization angle, e.g. for at least the purpose of maintaining communications.

Electronically controlled polarization adjustment device 106 may be configured to adjust at least a reception polarization tilt angle of antenna panel 100. Electronically controlled polarization adjustment device 106 may be configured to adjust at least a reception polarization tilt angle of antenna panel 100 in accordance with a polarization offset corresponding to a satellite selected for communication. Electronically controlled polarization adjustment device 106 may additionally or alternatively be configured to combine signals received in accordance with the first polarization associated with antenna panel modules 101 with signals received in accordance with the second polarization associated with antenna panel modules 101. Electronically controlled polarization adjustment device 106 may additionally or alternatively be configured to adjust one or more of amplitudes of the signals received and phases of the signal received for at least the purpose of achieving a combined signal that may correspond to a desired polarization tilt of antenna panel 100.

In some embodiments, e.g. of antenna panel 100, signal combining from the two linear polarizations, e.g. for at least the purpose of adjusting a polarization tilt angle, may be done separately for transmitted signals and for received signals. For example, two separated polarization adjustment devices may be used. As previously described, the reception polarization tilt angle may be adjusted electronically using electronically controlled polarization adjustment device 106. Once the reception polarization tilt angle is determined, a transmission polarization tilt angle may be determined. The transmission polarization tilt angle may be determined by adjusting the reception polarization tilt angle by 90 degrees. The polarization of transmitted signals may then be adjusted in accordance with the determined transmission polarization tilt angle using mechanically controlled polarization adjustment device 105.

FIG. 8, FIG. 9, and FIG. 10, show an example construction of antenna terminal 110, wherein FIG. 8 shows an isometric view of antenna terminal 110, FIG. 9 shows a side view of antenna terminal 110 and FIG. 10 shows a top view of antenna terminal 110. In some embodiments, antenna terminal 110 may be configured as a two way (e.g. receive and transmit) antenna terminal. As shown in FIG. 8, antenna terminal 110 may include a rotating platform 111, a static platform 112, an interface 113, and an antenna panel 114. These elements are described below in reference to FIGS. 9 and 10.

As shown in FIG. 9, antenna terminal 110 may include, in additional to antenna panel 114, an elevation motor and mechanics 122. Antenna panel 114 may be configured to be mounted on elevation motor and mechanics 122. Elevation motor and mechanics 122 may comprise an elevation motor component and an elevation mechanics component. The elevation mechanics and the elevation motor may be configured to enable pointing of the antenna beam at a desired elevation angle. For example, the elevation mechanics and the elevation motor may be configured to raise and lower the antenna panel 114 around an axis.

As shown in FIG. 10, antenna panel 114 of antenna terminal 110 may be configured to include four antenna panel modules (as shown for antenna panel 100). Antenna terminal 110 may further compromise a rotating platform 111, a static platform 112, an interface 113, an azimuth rotary joint 133, an elevation rotary joint 137, a waveguide 131 and a plate 136. The antenna terminal 110 may further comprise a protective cover (not shown in the above referenced figures).

Elevation motor and mechanics 122, on which the antenna panel 114 may be mounted, may be mounted on rotating platform 111. Rotating platform 111 may be configured to enable pointing of the antenna beam at any direction in the azimuth plane.

The rotating platform 111 may be configured to be mounted on static platform 112, wherein the static platform 112 may be configured to enable and secure mounting of antenna terminal 110 to a surface. For example, antenna terminal 110 may be mounted to a stationary surface, a roof of a moving vehicle, etc., via static platform 112. The static platform 112 may be further configured to include interface 113. Interface 113 may be configured to enable conveying one or more of RF signals and direct current (DC) power and (digital) control signals, to and from the antenna terminal 110. In some embodiments, rotating platform 111 may be mounted on the static platform 112 using the azimuth rotary joint device 133. Azimuth rotary joint device 133 may comprise at least an RF dual band rotary connection and a slip ring. The azimuth rotary joint device 133 may be configured to enable delivering one or more of RF signals and direct current (DC) power and (digital) control signals between the static platform 112 and antenna panel 114. In some embodiments, waveguide 131 may be coupled on a one end to the azimuth rotary joint device 133 and on the other end to the elevation rotary joint device 137. Waveguide 131 may be configured to convey at least one transmitted RF signal from the azimuth rotary joint device 133 to a port for transmitted signals of antenna panel 114 (e.g. port 108 as shown for antenna panel 100) via the elevation rotary joint device 137. In some embodiments, one or more devices (not shown in FIG. 10) configured to support elevation and mechanics 122 may be mounted on plate 136.

In some embodiments, at least one of the rotating platform 111 and the static platform 112 may be fabricated from reinforced plastic. Fabricating one or more of the rotating platform 111 and the static platform 112 from reinforced plastic may reduce the overall weight of the antenna terminal 110 and may reduce the cost of constructing antenna terminal 110. The plastic parts (e.g. the rotating platform 111 and/or the static platform 112) may be fabricated using any of one or more appropriate methods, including, but not limited to molding, milling, 3-dimensional (3D) printing, sintering plastic layers, or any other means of manufacturing. Construction of the plastic parts may comprise ribs and shells that may be configured to ensure a required stiffness of both the rotating platform 111 and the static platform 112.

In some embodiments, the antenna terminal 110 may be mounted on a stationary surface. In some embodiments, the antenna terminal 110 may be mounted, for example, on a roof surface of a vehicle. In some embodiments, the antenna terminal 110 may be mounted, for example, on a top surface of an airplane fuselage, e.g. taking advantage of the light weight of antenna terminal 110.

FIG. 11 illustrates an exemplary embodiment of an antenna platform 200, wherein antenna platform 200 may comprise at least an adaptor plate 201, a supporting structure 202, a rotating platform 205, and an antenna panel 204. The supporting structure 202 may be coupled to the adaptor plate 201. The rotating platform 205 may be coupled to the supporting structure 202. The antenna panel 204 may be mounted on the rotating platform 205 and may be similar to antenna panel 100 as previously described. In some embodiments, antenna platform 200 may be configured to be mounted on an airplane fuselage. The mounting of antenna platform 200 on an airplane fuselage may be in accordance with the Aeronautical Radio Incorporated (ARINC) 791 standard for Ku-band and Ka-band satellite data airborne terminal equipment.

Various aspects of the disclosure may be embodied as one or more methods, systems, apparatuses (e.g., components of a satellite communication network), and/or computer program products. Accordingly, those aspects may take the form of an entirely hardware embodiment, an entirely software embodiment, an entirely firmware embodiment, or an embodiment combining firmware, software, and/or hardware aspects. Furthermore, such aspects may take the form of a computer program product stored by one or more computer-readable storage media having computer-readable program code, or instructions, embodied in or on the storage media. Any suitable computer readable storage media may be utilized, including hard disks, CD-ROMs, optical storage devices, magnetic storage devices, and/or any combination thereof. In some embodiments, one or more computer readable media storing instructions may be used. The instructions, when executed, may cause one or more apparatuses to perform one or more acts described herein. The one or more computer readable media may comprise transitory and/or non-transitory media. In addition, various signals representing data or events as described herein may be transferred between a source and a destination in the form of electromagnetic waves traveling through signal-conducting media such as metal wires, optical fibers, and/or wireless transmission media (e.g., air and/or space).

Modifications may be made to the various embodiments described herein by those skilled in the art. For example, each of the elements of the aforementioned embodiments may be utilized alone or in combination or sub-combination with elements of the other embodiments. It will also be appreciated and understood that modifications may be made without departing from the true spirit and scope of the present disclosure. The description is thus to be regarded as illustrative instead of restrictive on the present disclosure.

What is claimed is:

1. An antenna panel module, comprising:

a grating lobes suppression layer comprising a cover configured to seal an aperture of the antenna panel module;

a radiating layer; and a feed layer comprising an orthomode polarizer and a first polarization summation circuit, wherein the first polarization summation circuit comprises a plurality of cavities configured to form a T-junction, wherein the T-junction is configured to sum signals from two or more elements of the antenna panel module in accordance with at least a desired amplitude distribution in the aperture of the antenna panel module, wherein the grating lobes suppression layer, the radiating layer and the feed layer are made of metalized plastic, conductive plastic, or a combination of metalized plastic and conductive plastic.

2. The antenna panel module of claim 1, wherein any of the grating lobes suppression layer, the radiating layer and the feed layer are produced using any of molding, milling, 3-dimensional printing, or sintering techniques.

3. The antenna panel module of claim 1, wherein the antenna panel module is configured to receive and/or transmit signals in two polarizations, wherein the first polarization summation circuit is configured to combine signals in accordance with a first polarization and to provide the combined signals associated with the first polarization through a first output port of the antenna panel module, and wherein the feed layer of the antenna panel module comprises a second polarization summation circuit configured to combine signals in accordance with a second polarization that is different from the first polarization and to provide the combined signals associated with the second polarization through a second output port of the antenna panel module.

4. The antenna panel module of claim 3, wherein the radiating layer comprises:

an array of horn antennas configured to receive or transmit broadband signals;

step-shaped square waveguides configured as feeds for the horn antennas; and a metalized plastic grid, wherein the metalized plastic grid is mounted on top of the array of horn antennas.

5. The antenna panel module of claim 4, wherein the orthomode polarizer is coupled to the array of horn antennas and wherein the orthomode polarizer comprises orthomode cavities configured to separate signals with different polarizations.

6. The antenna panel module of claim 3, wherein the second polarization summation circuit comprises multiple broad band step-tapered waveguide cavities configured to combine signals and formed in two metalized plastic parts, the two metalized plastic parts configured to be attached to one another at least upon assembly of the antenna panel module and to form the second polarization summation circuit, and wherein any of the two metalized plastic parts comprise weight reduction cavities configured to not interfere with operation of the second polarization summation circuit.

7. The antenna panel module of claim 6, wherein at least one of the multiple broad band step-tapered waveguide cavities of the second polarization summation circuit is configured to combine signals in accordance with at least a desired amplitude distribution in an aperture of the antenna panel module.

8. The antenna panel module of claim 3, wherein the antenna panel module is configured to receive and/or transmit signals in two orthogonal circular polarizations, and wherein the feed layer of the antenna panel module comprises at least a septum polarizer.

9. The antenna panel module of claim 8, wherein the radiating layer comprises:

an array of open-ended waveguide antennas configured to receive or transmit broadband signals;

step-shaped square waveguides configured as feeds for the open-ended waveguide antennas; and a metalized plastic impedance matching grid mounted on top of the array of open-ended waveguide antennas, wherein the septum polarizer is coupled to the array of open-ended waveguide antennas and wherein the septum polarizer comprises cavities configured to separate signals with different polarizations.

10. The antenna panel module of claim 1, wherein the plurality of cavities are road band step-tapered waveguide cavities formed in two metalized plastic parts, wherein the two metalized plastic parts are configured to be attached to one another at least upon assembly of the antenna panel module and to form the first polarization summation circuit, and wherein any of the two metalized plastic parts comprise weight reduction cavities configured to not interfere with operation of the first polarization summation circuit.

11. The antenna panel module of claim 1, wherein the antenna panel module is configured to receive and/or transmit signals in any of a Ku-band and a Ka-band.

12. An antenna panel, comprising:

one or more antenna panel modules, wherein each of the one or more antenna panel modules comprises a first port corresponding to a first polarization and a second port corresponding to a second polarization that is different from the first polarization, wherein each of the one or more antenna panel modules comprises a grating lobes suppression layer, a radiating layer and a feed layer, wherein the grating lobes suppression layer of each of the one or more antenna panel modules comprises a cover configured to seal an aperture of that antenna panel module, wherein the feed layer of each of the one or more antenna panel modules comprises an orthomode polarizer and a polarization summation circuit, wherein the polarization summation circuit comprises a plurality of cavities configured to form a T-junction, wherein the T-junction is configured to sum signals from two or more elements of that antenna panel module in accordance with at least a desired amplitude distribution in the aperture of that antenna panel module, wherein the grating lobes suppression layer, the radiating layer and the feed layer of each antenna panel module of the one or more antenna panel modules are made of metalized plastic, conductive plastic, or a combination of metalized plastic and conductive plastic, and wherein the number of antenna panel modules in the antenna panel is determined at least in accordance with a gain property of the antenna panel.

13. The antenna panel of claim 12, further comprising:

a first polarization waveguide combiner coupled to the one or more antenna panel modules through the first port of each antenna panel module of the one or more antenna panel modules;

a second polarization waveguide combiner coupled to the one or more antenna panel modules through the second port of each antenna panel module of the one or more antenna panel modules;

a diplexer comprising four ports, the diplexer being coupled to the first and second polarization waveguide combiners through a first port and a second port of the diplexer respectively;

a first polarization adjustment device coupled to a third port of the diplexer; and a second polarization adjustment device coupled to a fourth port of the diplexer.

14. The antenna panel of claim 12, wherein at least one of the one or more antenna modules is assembled from plastic parts that are produced using any of molding, milling, 3-dimensional printing or sintering techniques.

15. The antenna panel of claim 12, wherein at least one of the one or more antenna modules comprises weight reduction cavities configured to not interfere with operation of the antenna panel module.

16. The antenna panel of claim 12, wherein the antenna panel is mounted on an airborne platform.

17. The antenna panel of claim 12, wherein the antenna panel is configured to receive and/or transmit signals in any of a Ku-band and a Ka-band.

18. The antenna panel of claim 12, wherein the antenna panel is configured to receive signals from an earth-orbiting satellite and/or transmit signals to the earth-orbiting satellite.

19. The antenna panel of claim 12, wherein the antenna panel is configured to support airborne mobile communication over an earth-orbiting satellite.

20. An antenna system, comprising:

an antenna panel comprising one or more antenna panel modules, wherein each of the one or more antenna panel modules comprises at least one grating lobes suppression layer, at least one radiating layer, and at least one feed layer, wherein the at least one grating lobes suppression layer of each of the one or more antenna panel modules comprises a cover configured to seal an aperture of that antenna panel module, wherein the at least one feed layer of each of the one or more antenna panel modules comprises an orthomode polarizer and a polarization summation circuit, wherein the polarization summation circuit comprises a plurality of cavities configured to form a T-junction, wherein the T-junction is configured to sum signals from two or more elements of that antenna panel module in accordance with at least a desired amplitude distribution in the aperture of that antenna panel module, and wherein the at least one grating lobes suppression layer, the at least one radiating layer, and the at least one feed layer of each antenna panel module of the one or more antenna panel modules are made of metalized plastic, conductive plastic, or a combination of metalized plastic and conductive plastic; and a supporting structure, wherein the antenna panel is coupled to the supporting structure, and wherein the antenna system is configured to support mounting of the antenna system on a surface of an airplane fuselage.

21. The antenna system of claim 20, wherein the supporting structure is made at least in part from reinforced plastic.

22. The antenna system of claim 20, wherein the antenna system is configured to support mounting on a surface of an airplane fuselage in accordance with ARINC 791 standard.

* * * * *